US010583063B2

(12) United States Patent
Fagan

(10) Patent No.: US 10,583,063 B2
(45) Date of Patent: Mar. 10, 2020

(54) MANUAL WALK-ASSIST AND ACCESSORIES COMBO

(71) Applicant: Norval Nicholas Fagan, Brooklyn, NY (US)

(72) Inventor: Norval Nicholas Fagan, Brooklyn, NY (US)

(73) Assignee: Norval N. Fagan, Brooklyn, NY (US)

( * ) Notice: Subject to any disclaimer, the term of this patent is extended or adjusted under 35 U.S.C. 154(b) by 0 days.

(21) Appl. No.: 15/721,909

(22) Filed: Oct. 1, 2017

(65) Prior Publication Data

US 2018/0092795 A1 Apr. 5, 2018

Related U.S. Application Data

(60) Provisional application No. 62/566,376, filed on Sep. 30, 2017, provisional application No. 62/403,140, filed on Oct. 1, 2016.

(51) Int. Cl.

| | |
|---|---|
| ***A61H 3/00*** | (2006.01) |
| ***A61H 1/02*** | (2006.01) |
| *A61H 3/02* | (2006.01) |
| *A61H 3/04* | (2006.01) |

(52) U.S. Cl.

CPC ..... *A61H 3/00* (2013.01); *A61H 1/024* (2013.01); *A61H 2001/0248* (2013.01); *A61H 2003/0216* (2013.01); *A61H 2003/043* (2013.01); *A61H 2201/163* (2013.01); *A61H 2201/1642* (2013.01); *A61H 2201/1652* (2013.01)

(58) Field of Classification Search

CPC ..... A61H 1/024; A61H 2001/0248; A61H 2001/0216; A61H 2003/043; A61H 2201/163; A61H 2201/1642; A61H 2201/1652; A61H 3/00

See application file for complete search history.

(56) References Cited

U.S. PATENT DOCUMENTS

| | | | | |
|---|---|---|---|---|
| 8,057,410 | B2 * | 11/2011 | Angold | A61H 3/00 601/35 |
| 8,663,136 | B1 * | 3/2014 | Alsaffar | A61H 3/008 135/67 |
| 2002/0094919 | A1 * | 7/2002 | Rennex | A61F 5/0102 482/124 |
| 2006/0142105 | A1 * | 6/2006 | Kudoh | A61H 1/0237 475/10 |
| 2013/0231595 | A1 * | 9/2013 | Zoss | A61H 1/0255 601/34 |
| 2015/0272809 | A1 * | 10/2015 | Accoto | A61H 1/0237 623/31 |

* cited by examiner

*Primary Examiner* — Steven O Douglas

(57) ABSTRACT

A lower extremity wearable, that functions as a walk-aid, for those with a limited ability to walk, or those incapable of walking unassisted. The walk-aid also provides for other functions curtailed by paraplegia, and other health issues. The wearable is complemented with added utilities that_aid with the everyday use of the walk-aid. With low to average flexibility of legs, and the ability to stand for a period of time, the user will be able to simulate a walking motion with recurrent swings of a handle, regardless of disability. In contrast to other walk-aids currently available, the functions of the walk-aid are achieved without any motorization, computerization or outside power source.

7 Claims, 12 Drawing Sheets

MANUAL WALK-ASSIST AND ACCESSORIES COMBO

FIELD OF INVENTION

The present invention relates to the field of lower extremity exoskeletons that enable their users to walk and move in situations where they could not have before.

DESCRIPTION OF RELATED ART

In an effort to provide help for physically challenged persons, in respect to mobility of walk, companies and scientific programs often devise complex, computerized, battery powered or expensive walk-assist devices and gear.

BRIEF SUMMARY OF INVENTION

The present invention, is a manual walk-assist and accessories combo comprising of a motion control system, lower leg kick operation, leg stability system and accompanying accessories that enhances the user's ability to move and walk primarily via recurrent swings of the user's arms. The invention is best made essentially of any strong lightweight material such as plastic, aluminum, fiberglass, or any of a varying degree of plastics, metals and parts rubber. The motion control system comprises of those parts of the invention linked to the hip rotator, motion handle, planetary gear, rear sync gear, and the gait control. The lower leg kick operation comprises of the parallel tubes, upper and lower arch, with the lower arch atop the lower leg kick. The leg stability system utilizes the ankle and knee rotators, and those parts of the invention connected to them to reinforce the user's stance while standing, or travelling on stairs. The main accessories are those carried, but not limited to, those found on the utility rack on the user's back.

The invention seeks to provide a solution to the aforementioned complications of walk-assist devices and gear by focusing on six core values; that the invention is:

(1) Non-motorized
(2) Non-computerized
(3) Has no outside power source
(4) Has ease of use
(5) Has a quick learning curve
(6) Is relatively inexpensive to everything else in its field, currently on the market.

DETAILED DESCRIPTION OF THE INVENTION

Figure 1:
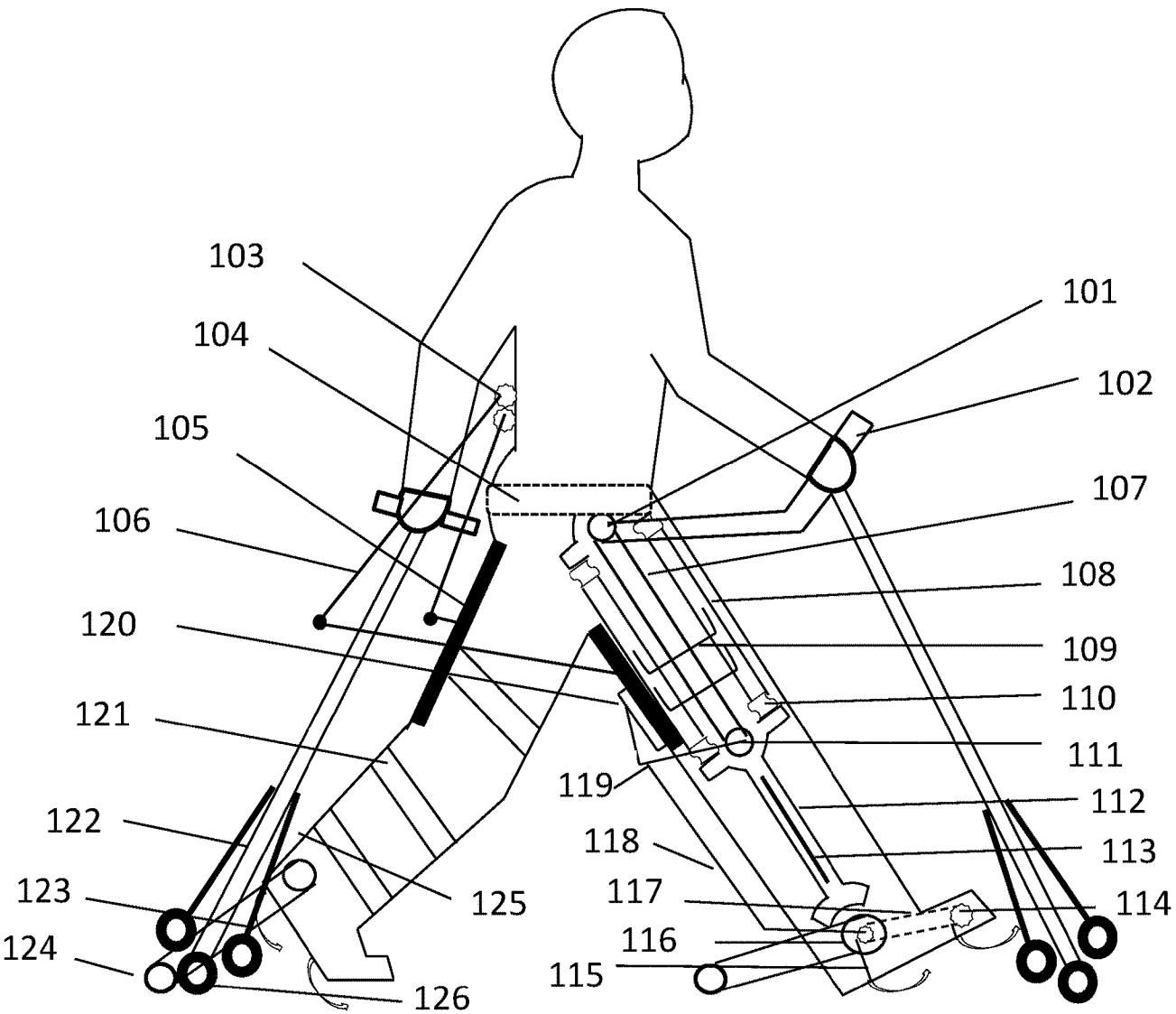
FIG. 1 is a general layout of the manual walk-assist.
Figure 2:
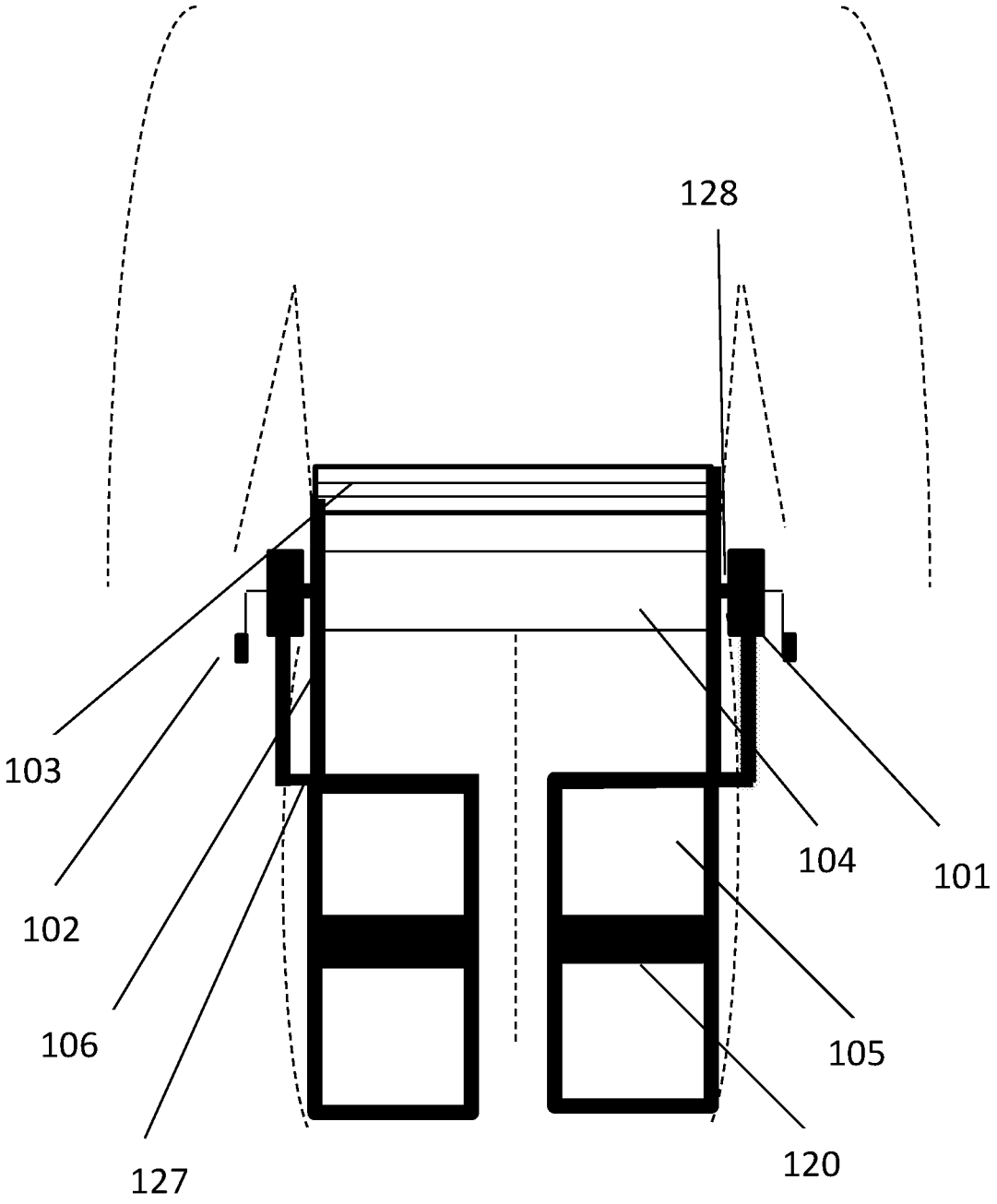
FIG. 2 shows the power sources of the manual walk-assist and their connection to the under-leg pad.

The invention is a manual walk-assist and accessories combo made essentially of light weight material and comprising of a motion control system, lower leg kick operation, leg stability system and accompanying accessories, that combine to enhance the user's ability to move and walk primarily via recurrent swings of the motion handles 102.

At the core of the invention are three types of rotators, one per each hip, knee and ankle. The hip rotator 101, in contrast to the other rotators, is where the primary power is derived. The other two rotators, work in tandem, allowing the user to free-stand.

The hip rotator rests atop the leg alignment. The leg alignment, the framework alongside the leg, holds the rotators and other leg attachments together and in place. The hip rotator is secured against a holding belt 104. The belt is wrapped around the user's waist. The preferred belt closure would be a fastener, like that of Velcro, but could be fastened by methods ranging from zips, hooks, buttons, or any of a number of fastening methods.

The hip rotator makes lateral turns by maneuvering around a swivel joint 128, or other jointed connection, on the inner side of the rotator. For every right and left turn of the handle, there is a corresponding movement of the leg and foot in the direction of where the user wants to go. This steering is achieved by way of the motion handles' ability to turn the entire leg alignment.

Within the hip rotator is the planetary gear 133, and attached to the planetary gear is the motion handle 102, which powers the planetary gear with recurrent swings of the handle by the user. The handle can be detached by pulling it off of the protruding molding that it covers. The swing of the motion handle sets in play upper leg movement by way of the arms 127 of the rotator, and their connection to the under-leg pad 105. For the purpose of this invention, the upper leg refers to that part of the leg above the knee, while as the lower leg bears reference to that part from the knee downwards. Also powering the motion handle is a stretchable band attached to the inner side of the planetary gear. When the user is standing, the band is wound up. When the user moves off to walk, the stored energy from the band, with the elasticity it possesses, helps to propel the handle backward. The hand upon the handle that goes backward moves forward the leg on that side of the user, while as the opposite action occurs on the other side of the user. This process helps to replicate a natural walking style.

Figure 3:
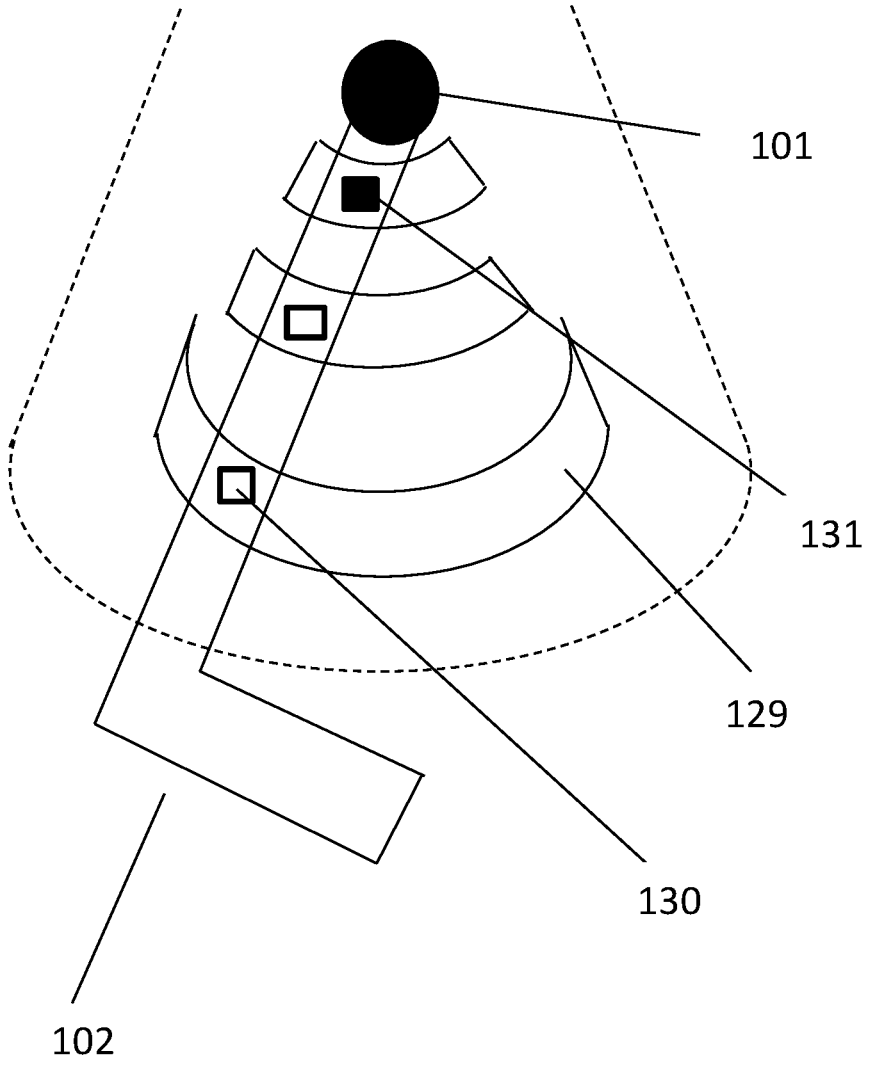
FIG. 3 shows the motion handle and the accompanying gait control apparatus.

Another set of gears, the rear sync gears 103, are gears codependent upon the movement generated by the planetary gears 133. The rear sync gears are a pair of long cylindrical gears located across the width of the user's lower back by the waistline. The ends of the gears are slightly elevated and secured above and on the hip rotator 101. The attached arms 106 of the rear sync gears reaches down to the under-leg pad 105, moving the pad in sync with the arms of the hip rotator. The rear sync gears turn against each other, providing a more synchronized stride when walking, having one leg staying back, as the other goes forward. This counter-balances the movement generated by the planetary gears. The rear gears are designed only for the purpose of walking, and they are to be disengaged when travelling on stairs, or any other leg movement. Disengagement is done by disconnecting the arms from the gears. In FIG. 3, the motion handle 102 is also the point at which gait control is managed. Alongside the motion handle is a set of three or more tracks 129, in line with notches 130 on the handle. The width and curvature of the track corresponds to various gait levels. By sliding a knob 131, up or down on the length of the handle, to the desired notch of the required track, the user can determine how wide a gait they will engage while walking, or even their travel on a flight of stairs.

Figure 4:
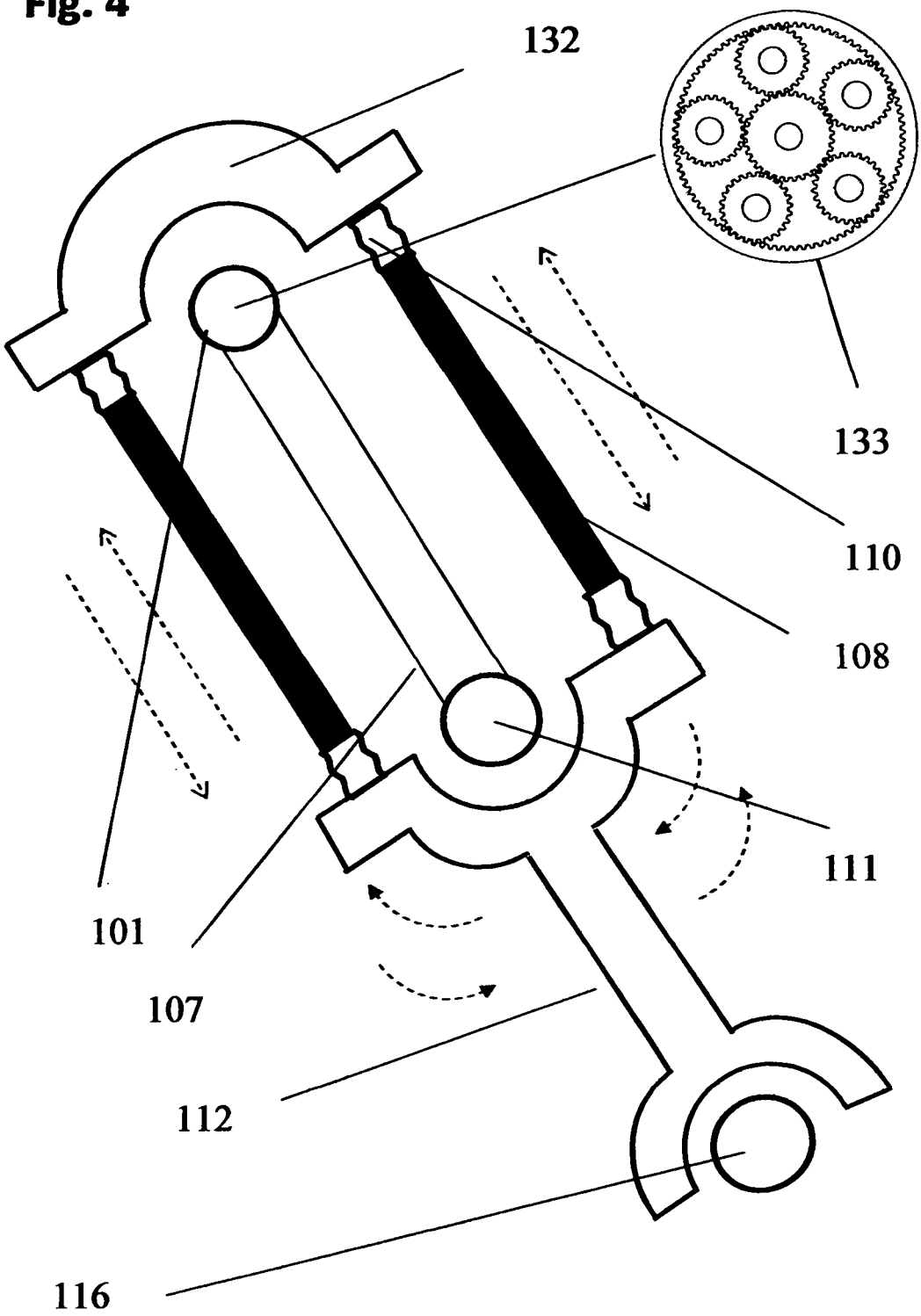
FIG. 4 is displaying the lower leg kick and the movement it makes when it is in motion. Also displayed is a cutout view of the planetary gear.

The lower leg kick 112 moves around the circumference of the knee rotator 111 as seen in FIG. 4. The top of the lower leg kick is arched, to accommodate the movement around the circumference of the rotator. The lower leg kick extends downward to where it fits around the ankle rotator 116. Movement of the lower leg kick is in line with the activity of the hip rotator 101, and swings of the motion handle 102. The lower leg kick moves in conjunction with movement of the upper leg but with a slightly delayed effect. The power generated by the hip rotator transfers to the lower leg kick with an upper arch 132 pushing down or pulling up on the two parallel tubes 108 alongside the thigh. The tubes are topped off with rubber corrugated ends 110, on both ends of the tubes. Inside the corrugated ends are springs providing the push and power to move the arches. The springs help control impact, flexibility and timing of movement. The corrugated ends are tipped with magnetized metal surfaces that fit into allocated spaces of the lower leg kick arches. The tubes need to be retracted to accommodate sitting or when travelling up a flight of stairs. The tubes can be retracted with pull handles 109 attached to the tubes, and the handles sit on hooks on the side of the leg, until the tubes are in use again.

Figure 5:
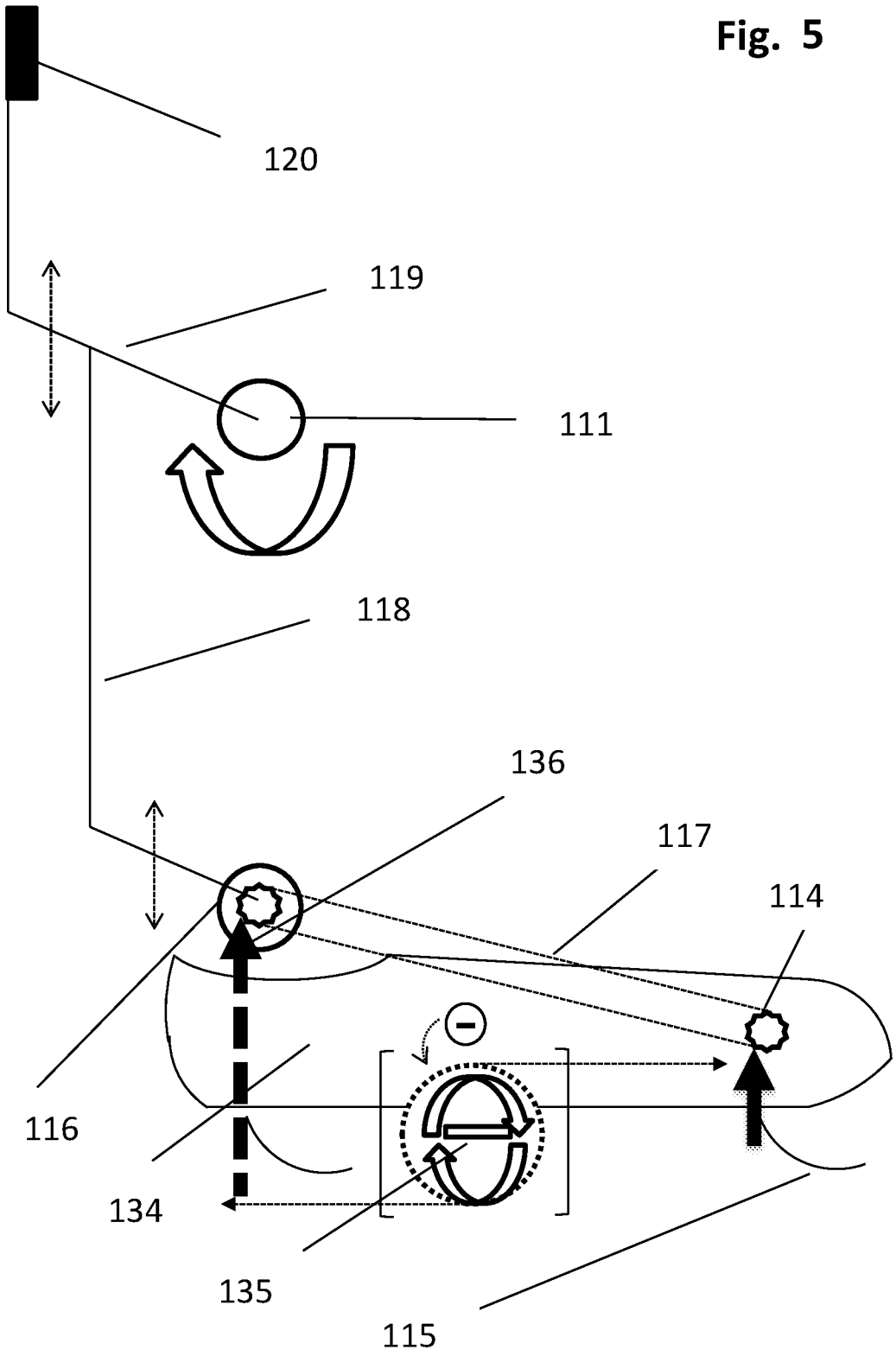
FIG. 5 provides an overview of the leg stability system.

The ankle and knee rotator 111 work in conjunction with each other in allowing the user to free-stand as shown in FIG. 5, and help when climbing stairs. At the base of both feet are lifts 115 under the heel and under the front of the flex-footing 134. In the process of walking, or standing, when the foot makes contact with the ground, the teeth 136 attached to the lift pushes up against their respective cogs 114, at the front or back of the foot, turning the ankle rotator. Regardless of the operation, the rear cogs have to turn for the leg stand operation to occur because of their attachment to the ankle rotator. The front cogs are able to turn the rear cogs via a connecting belt or chain 117 that runs between the two cogs. The knee rotator turns with the ankle rotator by way of a connecting rod 118, and attached cranks 119. With the rotators turning upward, the leg guard 120 pushes up against the back of the leg. This action ensures stability in the user's stand, and also gives the user added lift for when climbing stairs. Although both cogs can turn the ankle rotator, they are employed at different times. This is accomplished by alternating between the use of either lift, having them push against their respective cog when in use, or pushed away, when not. The rear lifts are used to push against the rear cogs when walking, because the heel generally connects first with the ground. The front lifts push against the front cogs, when ascending or descending stairs, because of how the foot lands either way. The user is able to alternate between the two by maneuvering a tab 135 on the side of the flex-footing 134.

Figure 6:
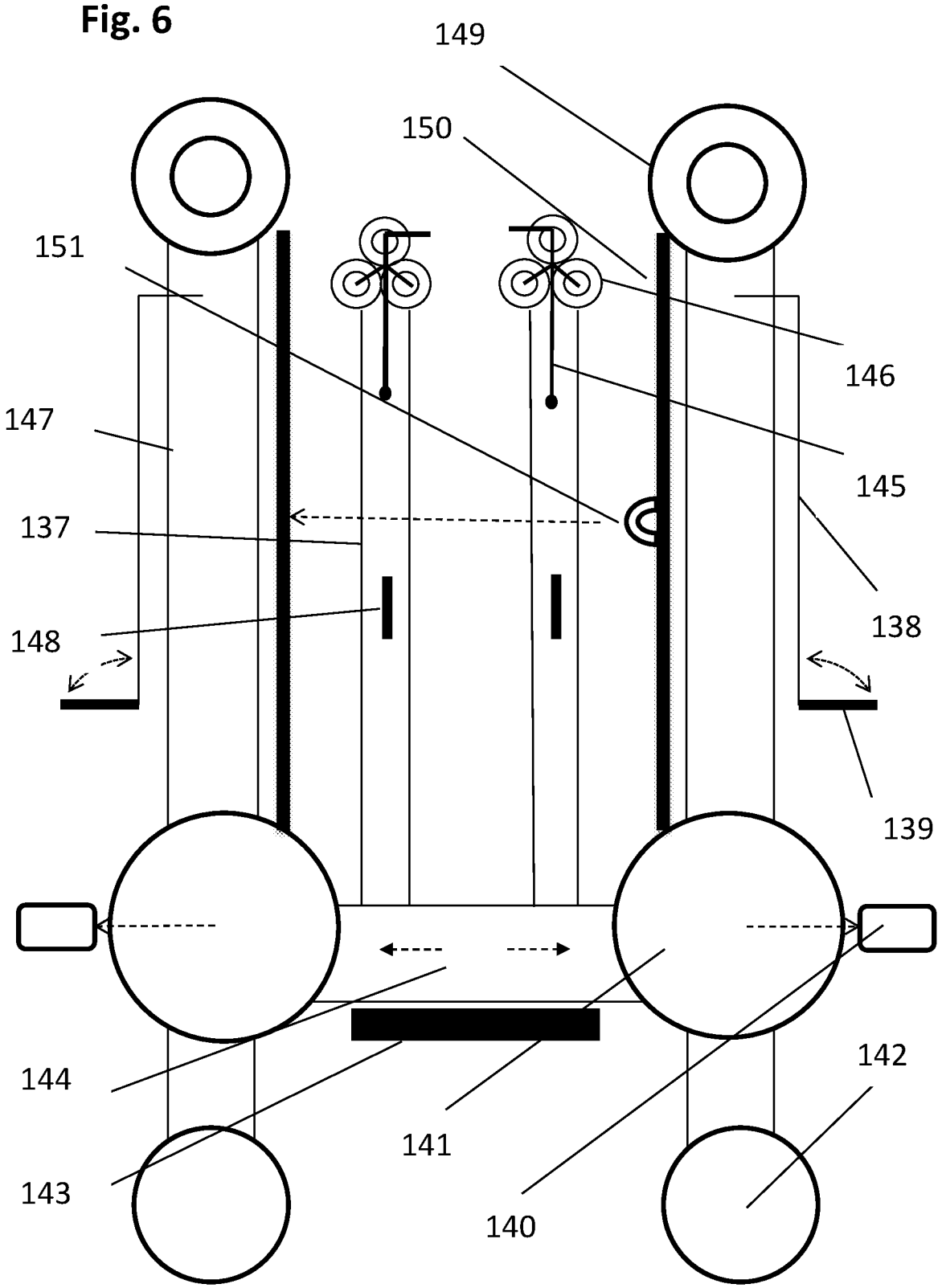
FIG. 6 shows the utility rack and all the related accessories.

Some of the accessories used for particular functions, when using the wearable, are stored on the utility rack 144 as shown in FIG. 6. These accessories are the stair support, wheel support, rail wraps 140, backrest, seat 143, and foot rest 152. The utility rack is held and locked on the hip rotator 101 by having it clamped around the circumference of the rotator.

Figure 7A:
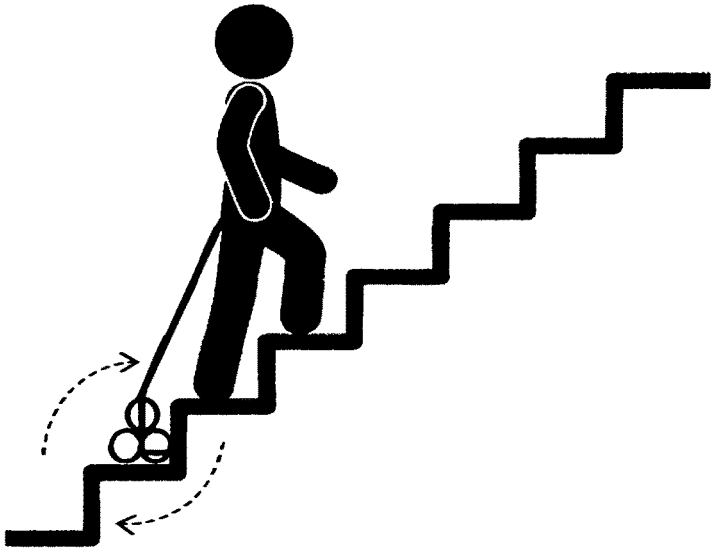
FIG. 7A shows the user with the stair support going up on stairs.
Figure 7B:
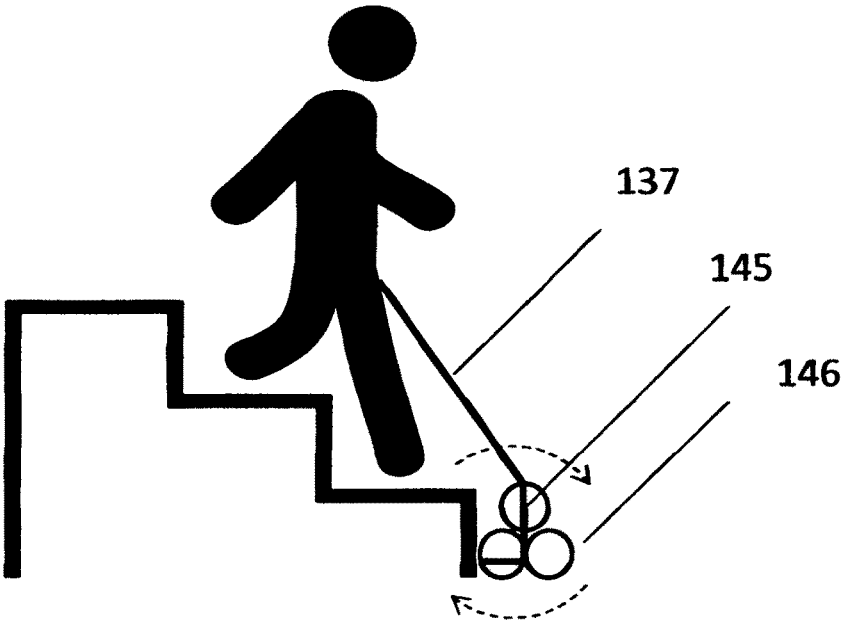
FIG. 7B shows the user with the stair support coming down on stairs.

The stair support pulls out from behind the back, and swings downward on the rack 144. The stair support arm 137 can be turned around on the rack, to accommodate whichever direction is taken on the stairs. The stair support can further extend with an inner arm. The inner arm is pushed down with a tab 148 on the outside arm. At the end of the inner arm are open ended L-brackets 145 through which a multi-wheeled stair climber appendage 146 passes through. The wheels of the stair climber are flanked on both sides by the L-brackets. The stair climber appendage is slightly buoyant, adjoined to the inner arm and brackets with a coil spring suspension, giving it some resilience on the ground. Also, the suspension is flexible enough to allow the L-brackets to push down around the wheels and touch the ground. The L-brackets are hinged on the inner arm with a slight dangle. The dangle facilitates the angle taken by the L-brackets on the step. At the bottom of the L-brackets is a rubber sole, which provides the grip necessary to avoid a slip on the stairs. When travelling on the stairs as shown in FIG. 7, the wheels of the stair climber move through the L-brackets. However, if the user should lose balance, or need to stop midway on the stairs, pushing down on the arm will press the L-brackets downwards to the step, providing an instant stop. The stair support has other uses ranging from stepping down from virtually any incline or even as legs for which the user can use to sit or lean back against while standing. The seat 143 from the wheel support can be used in such an instance for when using the stair support in such a way.

Figure 8:
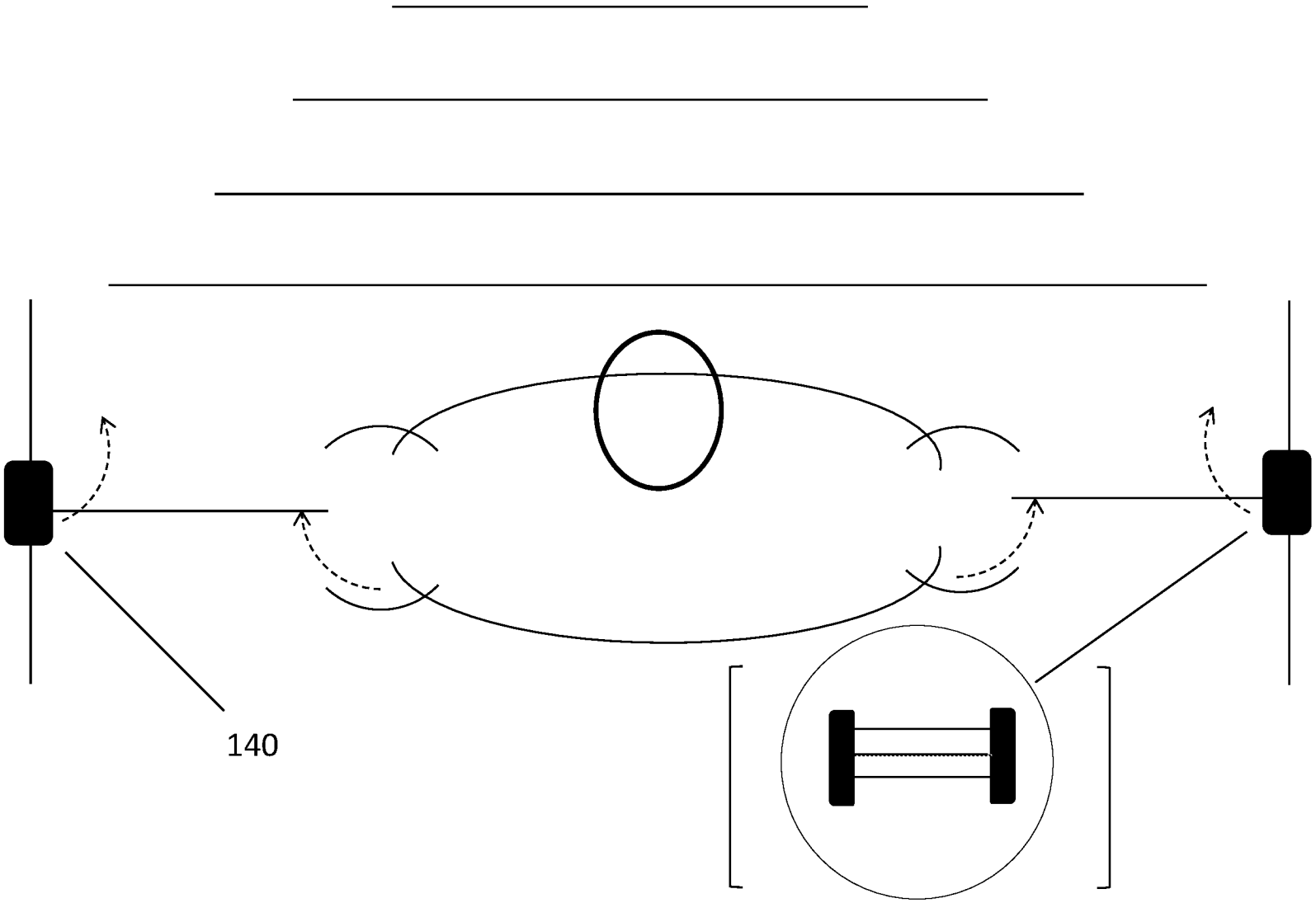
FIG. 8 demonstrates the rail wraps in use by the user. Also shown is a cutout view of the wraps extended.

Additional safety features, when travelling on stairs, are the rail wraps 140. The arms of the rail wraps extend outward from either side of the utility rack for use as seen in FIG. 8. The wraps fit around most any rail, and because of their adjustability, they are able to expand to fit larger rails. Found in the wraps are miniature wheels, allowing for an easy motion over most any surface. The rail wraps, and its arms, are designed to turn at an angle if the user should start to slip on the stairs. The limited angle turn of the wrap and arms holds the user in place.

Figure 9:
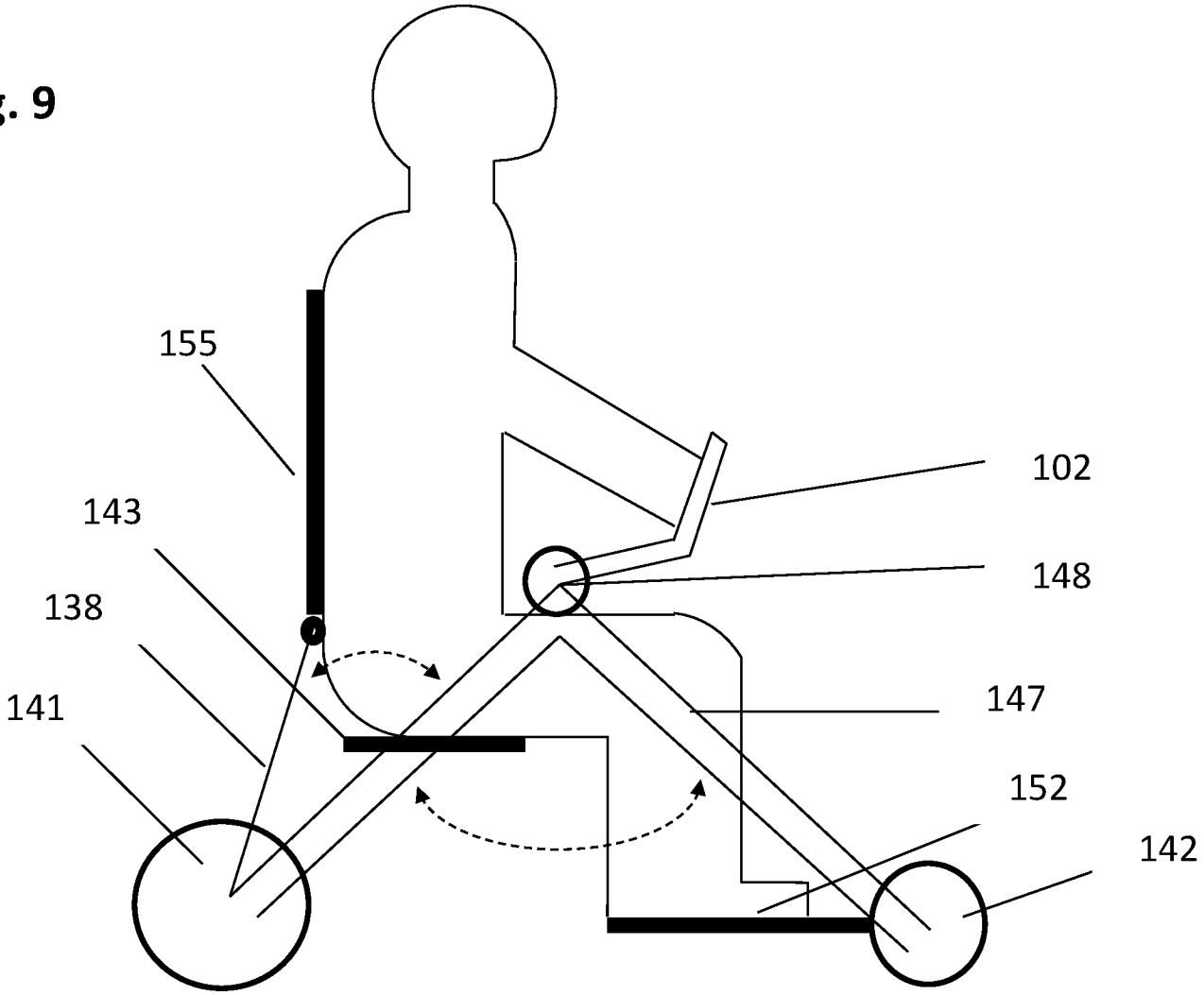
FIG. 9 shows the user using the wheel support, and all its attachments.

The wheel support, like the stair support, swing out from behind the back, and is then pulled out sideward. After being pulled out sideward, the support is pushed downward with the help of leverage arms 138 and their handles 139 alongside the support. The front (directional) wheels 142 first touch the ground, followed by the rear wheels 141. The wheel support can then be fully opened up, shown in FIG. 9, with the user slowly easing into a seated position by pushing downwards on the arms 147. After lowering themselves down, the user can now gain access to the seat and foot rest, that are attached to the support arms. The seat is positioned between the two rear arms, and the foot rest 152 opens up at the lower end of the front arm. At the apex, where the two arms meet, is a third wheel, the cycler 149, operated by the motion handle 102, which is detached from the planetary gear 133 for this function. A connecting belt or chain between the cycler and the rear wheel turns the two wheels when the user rotates the cycler with the motion handle. The cycler also directs the front wheel with left and right turns. Prior to using the wheel support, rear sync gears 103, the leg stability system, parallel tubes 108, and lower leg kick 112 must be disengaged.

The seating pad, between the two arms, rest on pulled out supports from the rear arms of the wheel support. While seated, the user can sit back with an available backrest in place. The backrest is accessed by pulling on a tab 151, attached to a mesh, or cloth, or any other similar functional backing, and hooking it around a second post 150 across from the first in the back.

The alignment bar 107, which lays between the knee 111 and ankle rotators 116, is an integral part of the leg alignment. When the parallel tubes 108, the lower leg kick and leg stability system is disengaged, the alignment bar is a constant operating feature that reinforces the leg alignment.

Other leg attachments of the leg alignment are the leg straps 121, under-leg pad 105, and spacer. The leg straps are assigned to both the upper and lower leg. The straps hold the alignment against the leg. The under-leg pad, located at the back of the upper leg, is connected to the hip rotator 101 and rear gears 103 via their respective arms. When power is generated from both sources, it pushes up against the pad, giving the leg lift and movement for the user's desired motion. The spacer is padding or molding, necessary to fill the gap that may exist between the leg of the user, and the leg alignment. For the components of the leg alignment to work effectively, it should be securely placed against the leg. The spacer helps achieve this by keeping everything uniformed alongside the leg.

For those users just starting out with the wearable or for those who do not feel entirely comfortable using it, training wheels 124 are available. These wheels trail behind the flex footing and are connected by extended arms 123 to the ankle rotators. The training wheels retain constant contact to the ground when walking by way of a coiled spring hinge between the arm and ankle rotator that pulls the wheel arm downward. When the wheels are not in use, the arm can be detached, or pulled upwards and hooked against the lower leg kick.

Figure 11:
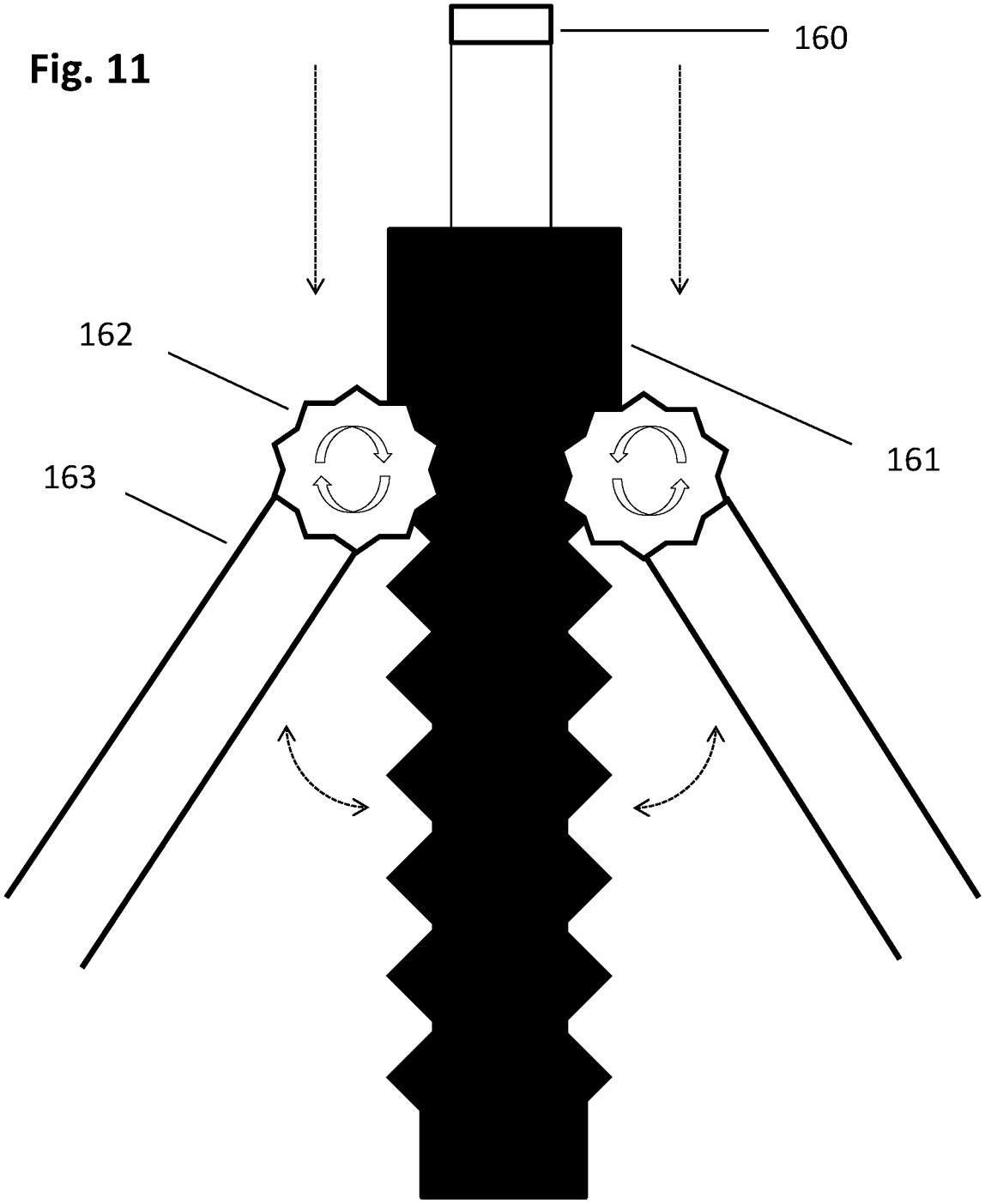
FIG. 11 shows the secondary stand and the effect of the central leg on the other two legs when it is pushed down.

On the side of the lower leg kick, there is a secondary leg stand 113, shown in FIG. 11 available to the user. The secondary leg stand comprises of three legs, and is accessible to the user by pushing down on a tab 160, which pushes down on the central leg 161 of the secondary stand. As the central leg pushes downward, it turns the gears 162 of the other two legs 163, pushing those legs outward. A layer of the central leg can then be pulled out sideward, giving the secondary stand the effect of a tripod on the side of the leg.

Figure 10:
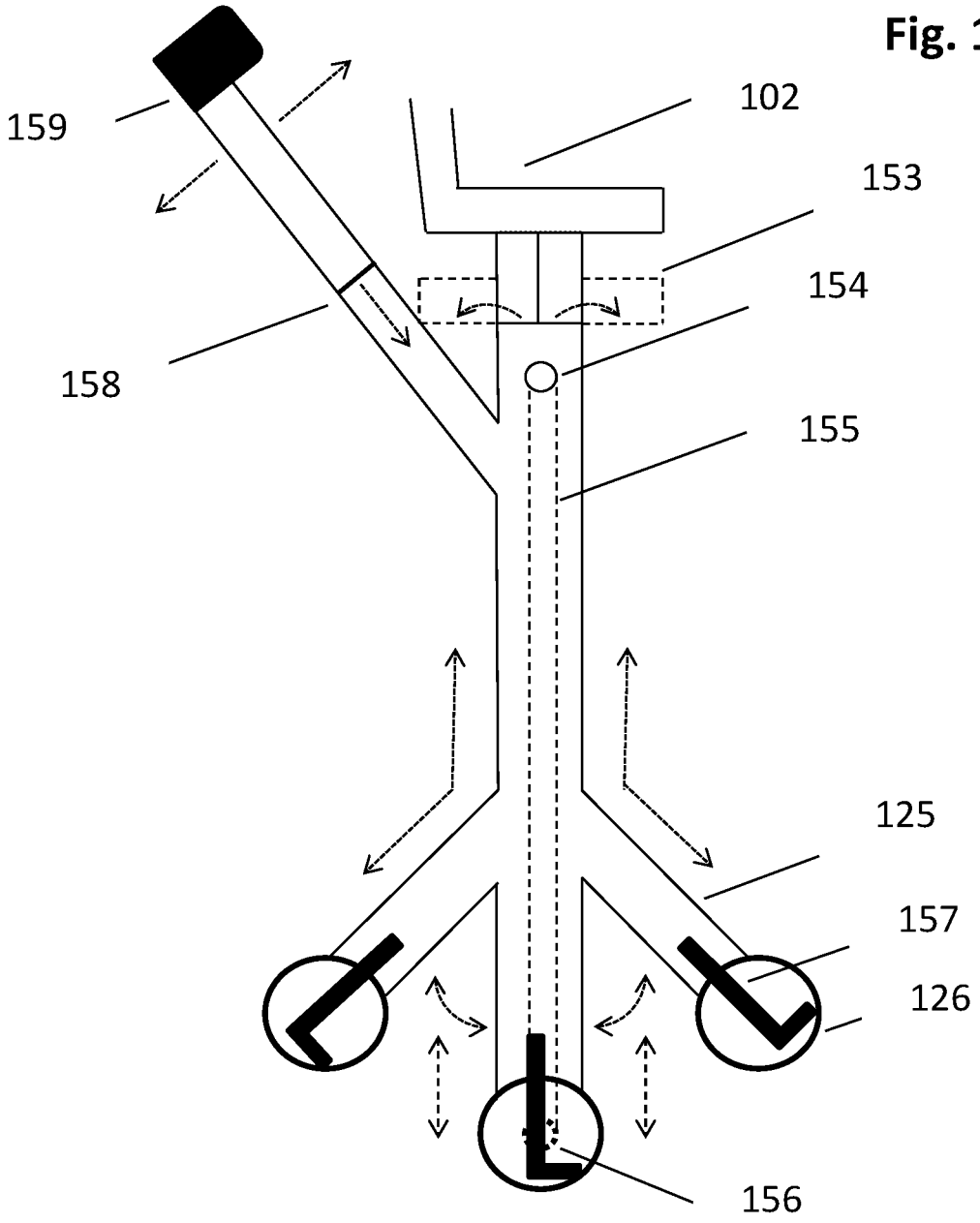
FIG. 10 shows the balance pole.

The balance poles 122, as seen in FIG. 10 are accessories primarily for walking, giving the user balance on either side. When used for walking, the balance pole is attached to the motion handle. On the sides, and lower half of the pole, are two branch legs 125 that pushes down and outward for walking. Both the pole and the branch legs have at their base a stop brackets 157 and wheels 126 that run between the L-brackets. As with the stair support, the wheel is attached by way of a coil spring suspension, which is resilient enough to allow the L-brackets to touch the ground when pressure is applied. The wheels also have a limited range of revolutions to avoid slips. The limited range of revolutions is done with stretchable bands wrapped around the wheels axle. The L-brackets at the bottom of the pole can effectively render the pole as a crutch if so desired by the user. The L-brackets also acts as a stop when saving the user from slipping. Attached at the top end of the balance pole is a cuff 159 on a cuff arm 158 that is adjustable for length and positioning to suit the user. The arm can be detached at the user's discretion. The balance poles also help the user ease into a sitting position, or help raise the user from a position of sitting to standing. This action is facilitated by twin built-in springs alongside each other, but in separate chambers within the poles. The springs are connected to the two top handles 153 on the poles and have different tensions. By pushing on the handle of the spring with the lesser tension, the user can ease into a sitting position. By pulling on the other handle, with the greater spring tension the user can pull themselves up from a seated position.

Also found near the top end of the pole is a dial 154, that when turned, turns the tab on the side of the foot. This is accomplished with the pole's lower-end rotator 156 positioned against a rotator encircling the tab on the side of the foot, and the dial on the pole turning that rotator. The dial at the top of the pole and the rotator at the bottom of the pole are connected preferably with a belt or chain 155, but any other conveyance that functions equally so will achieve this purpose.

Figure 12B:
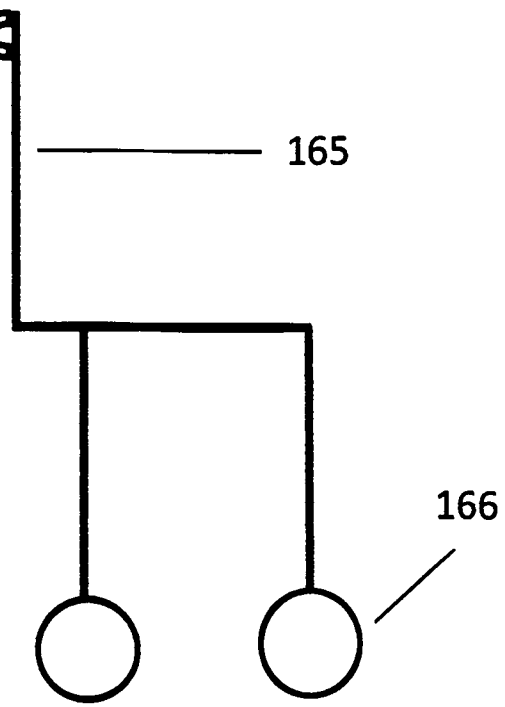
FIG. 12B provides a side view of the H-frame.
Figure 12A:
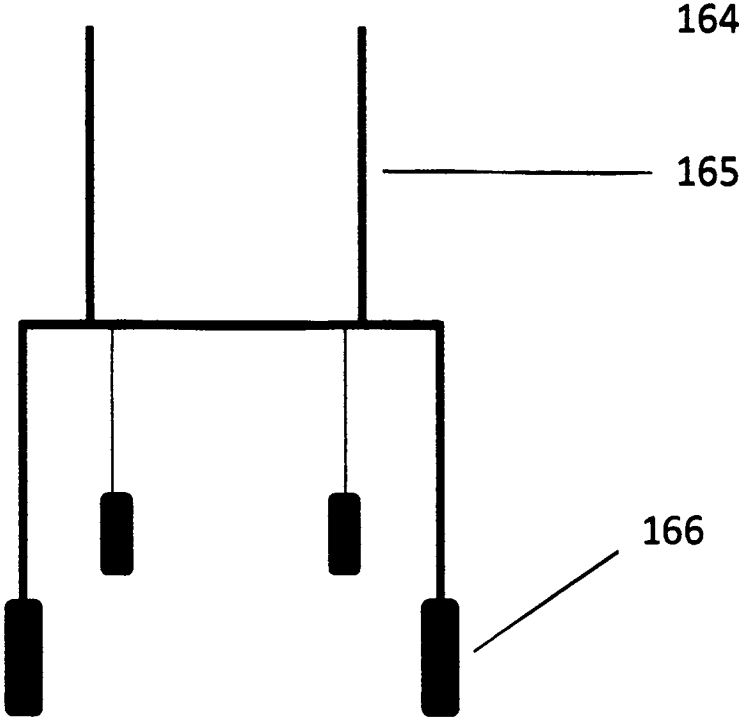
FIG. 12A provides a front view of the H-frame.

An option designed towards helping less flexible paraplegics, or even possibly, to some extent quadriplegics, is an H-frame body support 165, shown in FIG. 12. With this apparatus, the user receives the necessary support for the whole body, while benefitting from some functions afforded by the wearable. The H-frame body support also serves well as an introduction to the wearable, or as a rehabilitative device. The upper half of the frame is primarily designed to prop up the user, while the lower half, with the wheels 166 at the base, is geared towards mobility. The shoulder straps 164, at the top of the frame, help keep the user in place; while the mid-section, of the frame is tied into the holding belt 104 of the wearable for added stability.

REFERENCE NUMBERS FOR DRAWINGS PRESENTED IN FIGURES

The drawings depicted in the figures are for illustrative purposes only, and done mainly for the purpose of conveying the spirit of the invention. The drawings are not necessarily drawn to scale, and may fall short of being an exact representation of the invention as described in the patent. For example, the motion handle's depiction in the respective figures is not drawn to scale, and is drawn much more angular than the curvature it will have in its final design.

101—Hip Rotator
102—Motion Handle
103—Rear Sync Gear
104—Holding Belt
105—Under-Leg Pad
106—Rear Sync Arm
107—Alignment Bar
108—Parallel Tube
109—Pull Handle
110—Corrugated Ends
111—Knee Rotator
112—Lower Leg Kick
113—Secondary Stand
114—Cog
115—Lift
116—Ankle Rotator
117—Cog belt/Chain
118—Connecting Rod
119—Crank
120—Leg Guard
121—Leg Strap
122—Balance Pole
123—Training Wheel Arm
124—Training Wheel
125—Branch Legs (Pole)
126—Pole Wheels
127—Hip Rotator Arms
128—Motion Handle Swivel Joint
129—Track

130—Notch
131—Knob
132—Upper Arch
133—Planetary Gear
134—Flex-footing
135—Tab (Flex-footing)
136—Teeth (Lift)
137—Stair Support Arm
138—Leverage Arm
139—Leverage Arm Handle
140—Rail Wrap
141—Rear Wheel
142—Front Wheel
143—Seat
144—Utility Rack
145—Stop (L)-Bracket (Stair Support)
146—Stair Climber Wheel
147—Wheel Support Arm
148—Stair Support Arm Tab
149—Cycler
150—Backrest Post
151—Backrest Tab
152—Foot Rest
153—Top Handle
154—Pole Dial
155—Pole Belt/Chain
156—Pole Rotator
157—Stop Bracket (Pole)
158—Cuff Arm
159—Cuff
160—Tab (Secondary Stand)
161—Central Leg
162—Gear (Secondary Stand)
163—Branch Leg (Secondary Stand)
164—Strap
165—H-frame
166—Wheels (H-frame)

The invention claimed is:

1. A lower-body wearable walk aid, made essentially of light weight material, that allows the user to move and walk primarily via recurrent swings with a handle connected to a planetary gear, placed in proximity and adapted to be configured to the user's hips, with said walk aid comprising:

two interlocked elongated cylindrical gears placed at the rear of the user adapted to be configured in proximity to the user's waist and connected to the planetary gear, with each of the two interlocked elongated cylindrical gears attached to an arm extension, which is further attached to a pad adapted to be configured to the rear of user's upper leg;

a holding belt, adapted to be configured around the user's waist, against which the planetary gear is secured;

an arm extension attached to the planetary gear, with the arm extension further attached to the pad adapted to be configured at rear of user's upper legs;

a swivel joint, or other jointed connection, on the inner side of the planetary gear, wherein for every turn of the swivel joint, or other jointed connection, initiated by a lateral turn of the handle, there is a corresponding movement of the wearable walk aid in the direction of where the user wants to go;

a trio of arches, each of which is adapted to be configured to the user's hips, knees and ankles, wherein the trio of arches includes an upper arch moves around the planetary gear, a lower arch that circumvents a first rotary disc adapted to be connected to side of the user's knee, and a third arch, connected to the lower arch by a lower leg-length extension, circumventing a second rotary disc adapted to be configured to the user's ankle;

a pair of elongated tubes between the upper and lower arches, including corrugated casings enclosing inner springs, and tipped off with magnetized metal surfaces that fit into metallic allocated spaces of the trio of arches;

the handle includes a pair of pull handles attached to the elongated tubes, with which the elongated tubes can be retracted;

a pair of lifts, outfitted to footwear of the user, designed to move a pair of cogs at both the front and rear of said footwear, a conveyance between the two cogs, and a tab controlling movement of the cog;

a pair of cranks, each attached to the first rotary disc adapted to be configured to the user's ankle and side of user's knee, with a connecting rod between the two cranks, attached to an extension that is top-ended with a support adapted to be configured behind the user's upper leg; and a collection of straps, that hold together components of the lower-body wearable walk aid adapted to be configured against the user's leg.

2. The lower-body wearable walk aid of claim 1, wherein the handle, when moved in a swing motion, turns the planetary gear, with the arm extension moving the pad adapted to be configured at rear of user's upper leg.

3. The lower-body wearable walk aid of claim 1, wherein the pair of interlocked elongated cylindrical gears turns against each other, allowing for opposing movements of the pad adapted to be configured at rear of user's upper leg.

4. The lower-body wearable walk aid of claim 1 wherein the upper arch and lower arch move in tandem with every turn of the planetary gear; the lower arch movement producing a swing of the arm extension between the lower arch and the arch adapted to be configured to the user's ankle.

5. The lower-body wearable walk aid of claim 1 wherein the rotary disc, adapted to be configured to the user's ankle, work in conjunction with the rotary disc adapted to be configured to the side of the user's knee, with the attached cranks and connecting rod lowering or lifting the extension and the support, adapted to be configured behind the user's upper leg.

6. The lower-body wearable walk aid of claim 1, further including a gait control operation, placed alongside the handle, comprising of a plurality of notches aligned with an equal number of individual tracks, wherein a knob on the handle, when slid to the designated notch, the width and curvature of the track being used, distinguishes various gait levels, determining how wide a gait the user will engage while walking, or travelling on a flight of stairs.

7. The lower-body wearable walk aid of claim 1, further including a collection of accessories featuring a number of items that can be used with the lower-body wearable walk aid, comprising:

a rack, for the conveyance of other accessories, adapted to be configured at the rear of the user's waist, and locked on the planetary gear;

a wheel trailing behind the user, attached with a wheel arm to the first rotatory disc adapted to be configured to the user's ankle, wherein said wheel retains constant contact to the ground via a coiled spring hinge, between the extension arm and the first rotatory disc, that pulls the wheel arm downward;

a pair of stair-access accessories, consisting essentially of arms with a retractable inner arm extension connected to a pair of hinged L-shaped brackets with a rubber sole, and an arrangement of wheels that pass through the pair of hinged L-shaped brackets;

a pair of arms attached to a wrap, that has a plurality of miniature wheels on the underside of the wrap;

a wheel support consisting essentially of an arrangement of wheels with a pair of arms that connect them, a conveyance between a rear and upper set of wheels, a seat, a foot rest, a backrest, a pair of backrest posts, and a backrest tab;

a pair of balance supports having a central leg, and a pair of branch legs, with each leg equipped with a wheel encased by a pair of rubber soled L-shaped brackets;

a cuff on an adjustable arm attached to an upper end of the balance support;

a pairing of built-in springs, each with different tensions within separate chambers of the balance support, with the built-in springs including handles protruding from the stem of balance support;

a pair of leg stands consisting essentially of three legs each, with a tab attached to the central leg including an extra layer or flap; and a supportive mobile frame coupled to a plurality of wheels and a pair of shoulder straps.

* * * * *